United States Patent [19]

Bascou

[11] 4,333,269

[45] Jun. 8, 1982

[54] AUTOMATIC CONTROL AND LOCKING DEVICE

[75] Inventor: Jacques Bascou, Boulogne-Billancourt, France

[73] Assignee: Regie Nationale Des Usines Renault, Boulogne-Billancourt, France

[21] Appl. No.: 131,013

[22] Filed: Mar. 17, 1980

[30] Foreign Application Priority Data

Mar. 16, 1979 [FR] France ..... 79 06766

[51] Int. Cl.[3] ..... E05F 15/00

[52] U.S. Cl. ..... 49/280

[58] Field of Search ..... 49/349, 280

[56] References Cited

U.S. PATENT DOCUMENTS

| | | | |
|---|---|---|---|
| 2,817,512 | 12/1957 | Christen | 49/349 X |
| 3,318,049 | 5/1967 | Arlanskas | 49/280 |
| 3,343,303 | 9/1967 | Wanlass | 49/280 |
| 3,713,472 | 1/1973 | Dozois | 49/280 |

FOREIGN PATENT DOCUMENTS 7406645 9/1974 France .

*Primary Examiner*—Kenneth Downey

*Attorney, Agent, or Firm*—Oblon, Fisher, Spivak, McClelland & Maier

[57] ABSTRACT

A device is disclosed for the automatic remote control and locking of a trunk lid or hatchback 1 connected by a hinge to the upper part of an automobile body around a transverse axis 2 and balanced by a stabilizing device. The hatchback 1 may be controlled by means of a rod 12 which is connected at one end to the hatchback and at the other end to a point of a first cogged sector 17 which is caused to rotate, along a predetermined path, by a remote-controlled electric motor 11. The hatchback may, in addition, be automatically locked after folding back onto the body portion of the trunk 3 by mechanical means 13, 18, 31 brought into play by the electric motor once the rod and first sector have stopped working.

6 Claims, 11 Drawing Figures

FIG. 8
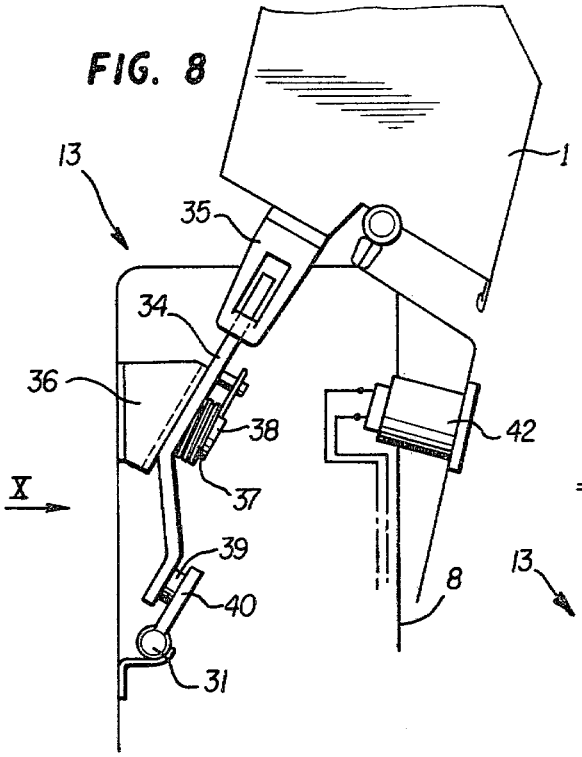
FIG. 9
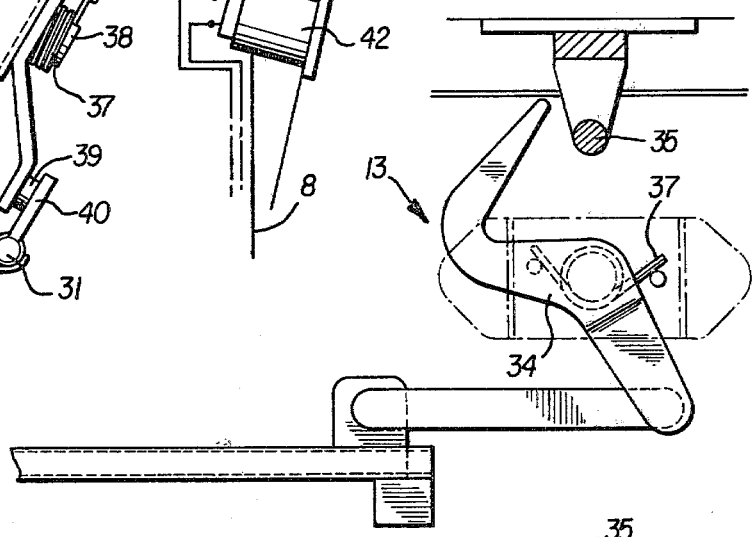
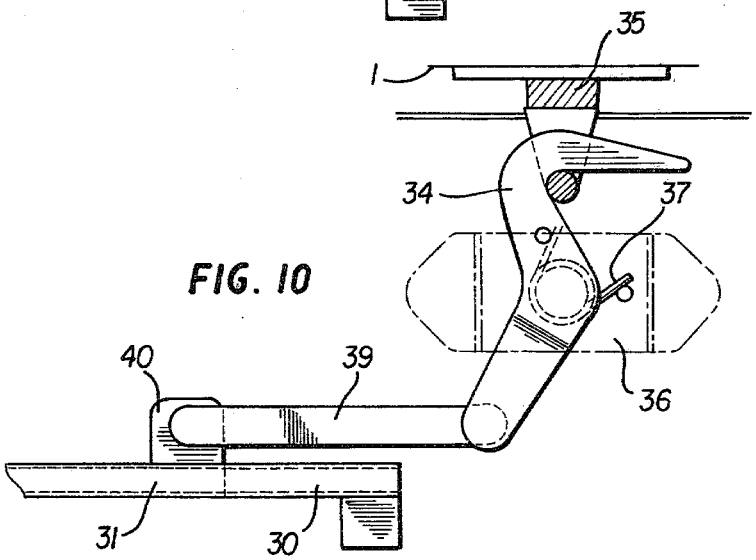
FIG. 10

AUTOMATIC CONTROL AND LOCKING DEVICE

BACKGROUND OF THE INVENTION

1. Field of the Invention

The present invention relates to an automatically commanded device for the remote control and locking of a trunk lid or hatchback of an automobile.

2. Description of the Prior Art

There are known devices for controlling and locking the side doors of a vehicle automatically, by means of an electric motor operated reduction gear arranged within the body of the door, for example. After the movements are suitably transformed, a cable acts on the pin of the lock to unlock the door and a pushrod then opens the door by pressing against the fixed part of the body in the door frame. By reversing the direction of rotation of the motorized reduction gear, the door is reclosed and automatically locked following the reverse order of operating steps.

There are other known devices, sometimes kinematically quite complex, which make it possible to automatically control the rear hatch of an automobile but do not involve consecutive automatic locking, of which the present applicant is aware.

SUMMARY OF THE INVENTION

It is an object of the present invention, in the context of using a hatchback, to complete the automatic process by the remote controlled locking thereof, using the same activator used for controlling the hatch movement itself.

In addition, the present invention proposes a new structure for the control mechanism which is neither bulky nor costly and is well adapted to the hatchback or trunk lid of a vehicle.

To that end, the present invention includes a remote control device for the automatic control and locking of a trunk lid or hatchback connected by a hinge to the upper part of an automobile about a transverse axis and balanced by a stabilizing device. The hatchback may be controlled by means of a rod which is connected at one end to the hatchback and at the other end to a point on a first cogged sector which is caused to rotate, along a predetermined path, by a remote-controlled electric motor. The hatchback may, in addition, be automatically locked after folding back onto the body portion of the trunk by mechanical means which are brought into play by the electric motor once the rod and first cogged sector have stopped working.

The locking methods for the hatchback, following its closure, consist essentially in a second cogged sector, adjacent and parallel to the first sector and pivoting with it around a common axis which is part of a support plate. After the first sector is immobilized, the motor continues to rotate the second sector, which results in the rectilinear displacement of a cable sliding in a sheath. The end of the cable causes a hook-shaped pin to pivot, said pin being part of the trunk, so as to lock into a keeper in the hatchback.

The electric motor may be remotely controlled in an appropriate manner for the opening or closing of the hatchback either from inside the vehicle or from the outside by using a trunk key. A supplementary switch inside the trunk makes it possible to neutralize the inside control so as to permit the separation of the locking of the trunk from that of the side doors, an antitheft safety measure in use on most vehicles.

The hatchback control mechanism using a hinged rod is mounted on one side of the vehicle, while the other side continues to have a standard type of stabilizing device, e.g., a telescoping one. However, the balancing force provided by the remaining stabilizing device should be such that it is possible to sharply limit the required power of the motor. In practical terms, a power-window type motor proves to be powerful enough to activate the locking cable and bring on the raising of the hatchback through the pivoting of the cogged sectors.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIG. 8 shows the locking mechanism, seen in the same plane as FIG. 1;

FIGS. 9 and 10 show the locking mechanism following arrow X of FIG. 8, for the unlocked and locked states of the hatchback, respectively.

DETAILED DESCRIPTION OF THE PREFERRED EMBODIMENTS

Figure 1:
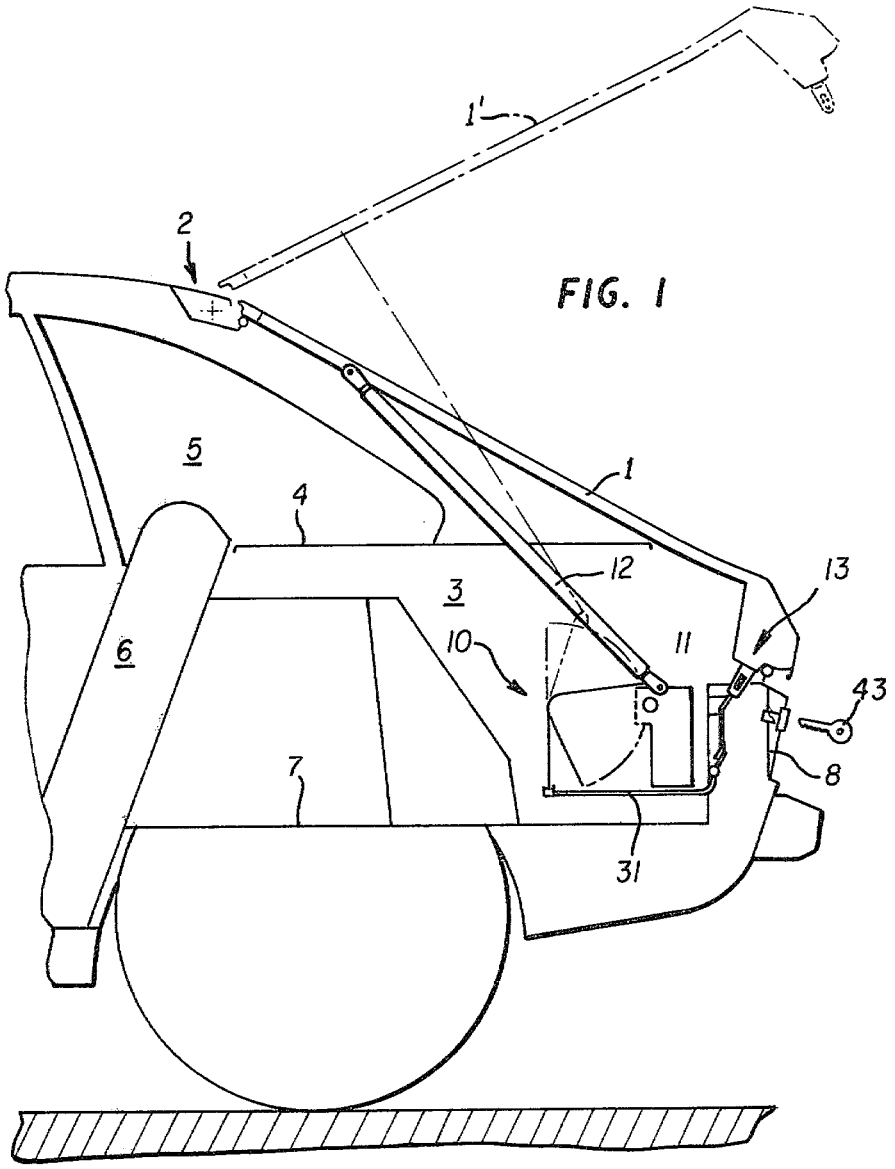
FIG. 1 shows the device in cross section according to the invention used on the hatchback of an automobile.
Figure 6:
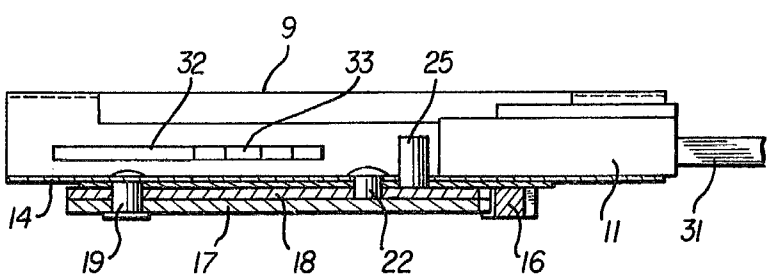
FIG. 6 shows a cross section of the mechanism along line VI of FIG. 2.

With reference to FIG. 1, there may be seen, in cross section, the rear of an automobile equipped with a hatchback 1 that pivots at the upper part of the automobile body around a transverse axis 2. The baggage compartment 3 is defined by the hatchback 1 itself, the horizontal panel 4 for separating the trunk 3 from the passenger compartment 5, the rear surface of the rear seat backs 6, the lower floor 7 and the body of the trunk formed by the rear panel 8 and the lateral walls 9 of the auto body (FIG. 6).

In accordance with the invention, the hatchback 1 may be controlled and locked automatically by means of a mechanism 10 with cogged sectors activated by an electric motor 11 and acting successively on a rod 12 connected by a hinge between the hatchback and one of the cogged sectors, and by a lock 13 serving to lock the hatchback 1 against the body 8, 9 of the trunk.

FIG. 1 represents the entire device, the various operative parts of the mechanism being grouped on a plate 14 attached inside the trunk 3 against the vertical wall 9 of the body on the right side (direction of travel of the vehicle) in the embodiment shown.

The FIG. 1 cross section does not show the presence of a hatchback stabilizing device of any type. A telescoping stabilizing device, for example, mounted on the left side of the body, the conventional role of which is reducing the effort required for controlling and offsetting the weight of the hatchback 1 is provided.

The plate 14, represented in FIGS. 2 through 6, is mounted on the body 9 by an attachment foot 15 and supports a small low-power electric motor 11, of the reduction gear type used for power windows, the output pinion 16 of which moves two cogged sectors 17, 18 which are mounted to pivot on the plate around a common axis 19. The two sectors 17, 18 are adjacent, parallel to the plate 14 and of the same diameter, so that the pinion 16 may drive them simultaneously in rotation.

However, the curvilinear length of the toothing 20 of the first cogged sector 17, intended for the control of the hatchback 1, is less than the curvilinear length of the toothing 21 of the second sector 18, intended for locking, so as to cause the locking of the hatchback to take place after its closure or, vice versa, to produce the opening of the hatchback after its unlocking.

The first sector 17, which is farthest from the plate, has a pin 22 which is guided in the first curvilinear slot 23 of the plate 14 after having crossed the second sector 18, which is interposed between the first sector 17 and the plate 14. To allow it to move with respect to the first sector, the second sector 18 itself has a curvilinear slot 24 superimposable over the first slot 23 in the plate but shorter in length. In addition, the second sector 18 also has a pin 25 which is guided through a second curvilinear slot 26 in the plate, slot 26 being parallel to the first slot 23 and of a length which is adapted to the functioning of the locking process which will be described below.

Figure 5:
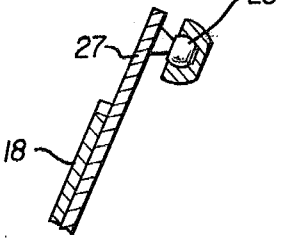
FIG. 5 shows the hinging of the rod following cross section V of FIG. 2.

Finally, the cogged sector 17 intended for the control of the hatchback is extended along one rectilinear side by an arm 27 on the end of which is a swivel joint 28 for connecting with the rod 12 as represented in FIG. 5.

The locking of the hatchback 1 is obtained through the transformation and the subsequent transmission of movement from the plate 14 to the lock 13.

Figure 7:
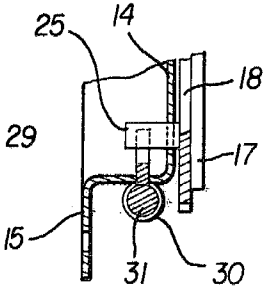
FIG. 7 is a cross section along line VII of FIG. 4.

To that end, the lower part of the plate has the form of an elbow 29 (FIG. 7) which supports a sheath 30 in which a transmission cable 31 slides.

Furthermore, the lower elbow 29 of the plate has a longitudinal slit 32 penetrated by a two-pronged fork attached to part of the cable 31 and hence able to move with it over the path determined by the length of the slit 32 (FIG. 6).

The relative positions of the slit 32 and the second curvilinear slot 26 of the plate, as well as the trajectories of the fork 33 and the pin 25 of the locking sector 18, are such that the fork may be moved by the pin becoming engaged between the prongs of the fork, thereby ensuring the transformation from circular to rectilinear movement or vice versa depending on the direction of rotation of the motor 11.

Figure 2:
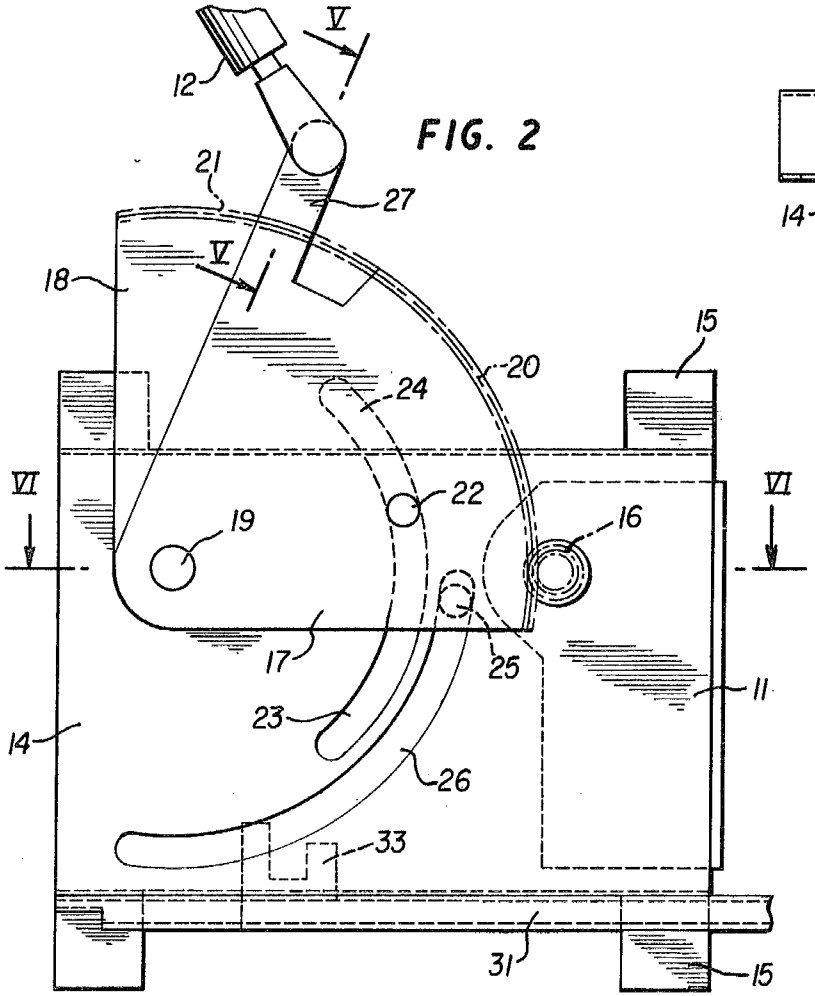
FIGS. 2, 3 and 4 show various sequences of the control mechanism, seen in the same plane as FIG. 1, for the open, closed and locked positions of the hatchback, respectively.

To make it possible for the pin to engage or disengage, the prongs of the fork 33 are different lengths (FIG. 2). At the other end of the cable 31 (FIGS. 8 to 10), the rectilinear movement is used for remote activation of the lock, there being a hook-shaped pin 34 which, when pivoted, locks into a keeper 35.

The keeper, a fixed element of the lock, is a simple stud hole on the lower part of the hatchback 1. The pin 34 is hinged on a support 36, itself attached to the plating of the rear panel 8 of the body. The end of the hook 34, shaped like a cam, is engaged in the keeper 35 to lock the hatchback against the body of the trunk. The trunk is also returned to an unlocked position by a coil spring 37 wrapped about the hinging axis 38 of the hook.

Transformation from rectilinear to circular movement is obtained by means of a small pin 39 hinged between the hook 34 and a foot 40 which is fixed with the end of the cable 31.

This foot slides to the end of the sheath 30 in the same manner as the fork 33 described previously.

Figure 11:
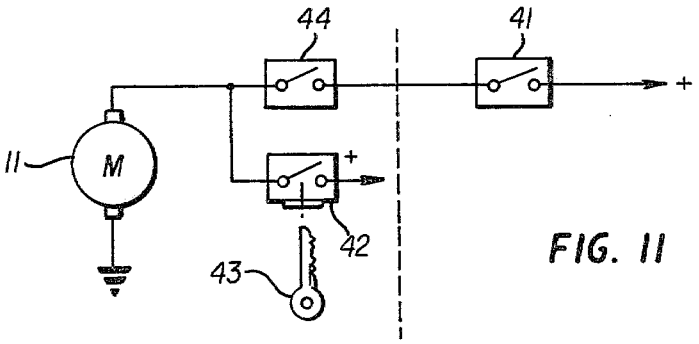
FIG. 11 shows one example of the electric motor control circuit.

By way of example, the electrical control of the motor 11 may be represented schematically by the circuit in FIG. 11. It shows simply that the motor may be set into motion in the desired direction either by a switch 41 located in the passenger compartment, on the dashboard, for example, or by an outside switch 42 operated by means of a kay 43 and mounted on the rear panel 8 of the body (FIGS. 1 to 8).

In addition, a switch 44, located in the trunk and part of the control circuit going to the passenger compartment, makes it possible to neutralize control 41 so as to retain only the external control point 42. This optional provision makes it possible to avoid access to the trunk 3 by simply breaking in to the passenger compartment 5. Moreover, elimination of control from the passenger compartment 41 has no effect on the case in which the user is required to move in order to use the trunk 3 himself.

The device according to the invention functions as follows:

We begin in the open position of the hatchback 1 (FIG. 2), for which the two cogged sectors 17, 18 are in the upward position, butting against the end of the first slot 23 of the plate through the intermediary of the pin 22 of the first sector, which crosses in succession through the second sector 18 and then the plate 14 (FIG. 6).

Figure 3:
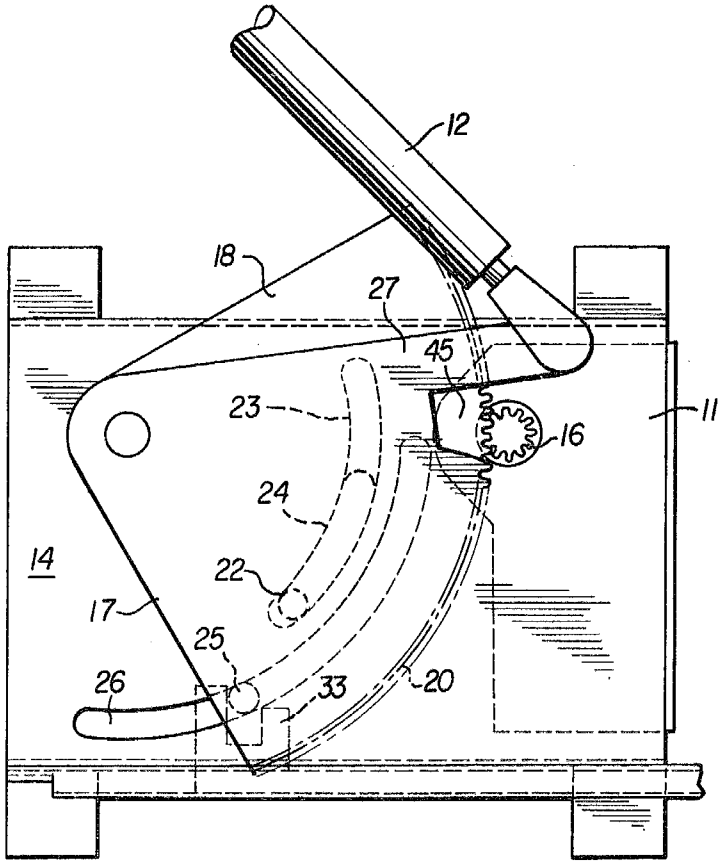

After giving instruction to the motorized reduction gear 11 to move in the proper direction by using one of the switches described above, the output pinion 16 simultaneously engages the two cogged sectors, making them pivot until the position in FIG. 3 is reached, corresponding to the closed hatch resting against its watertight seal after being pulled by the hinged rod 12 attached to the control sector 17.

Simultaneously, the pins 22, 25 of the two sectors move in their respective slots in the plate while retaining their relative angular separation in relation to that shown in FIG. 2.

The control sector 17 stops moving as soon as the pin 16 reaches the cogging stop 45 separating said cogging 20 from the hinge arm 27. The path of the first sector 17 corresponds in large measure to the length of the first curvilinear slot 23 of the plate, while the pin 25 of the second sector (the locking sector) becomes engaged between the prongs of the fork 33 placed on the trajectory of the second curvilinear slot in the plate. This position of the fork corresponds with the position of unlocking of the keeper 35, represented in FIG. 9, a position which is maintained by the return spring 37 of the pin.

Figure 4:
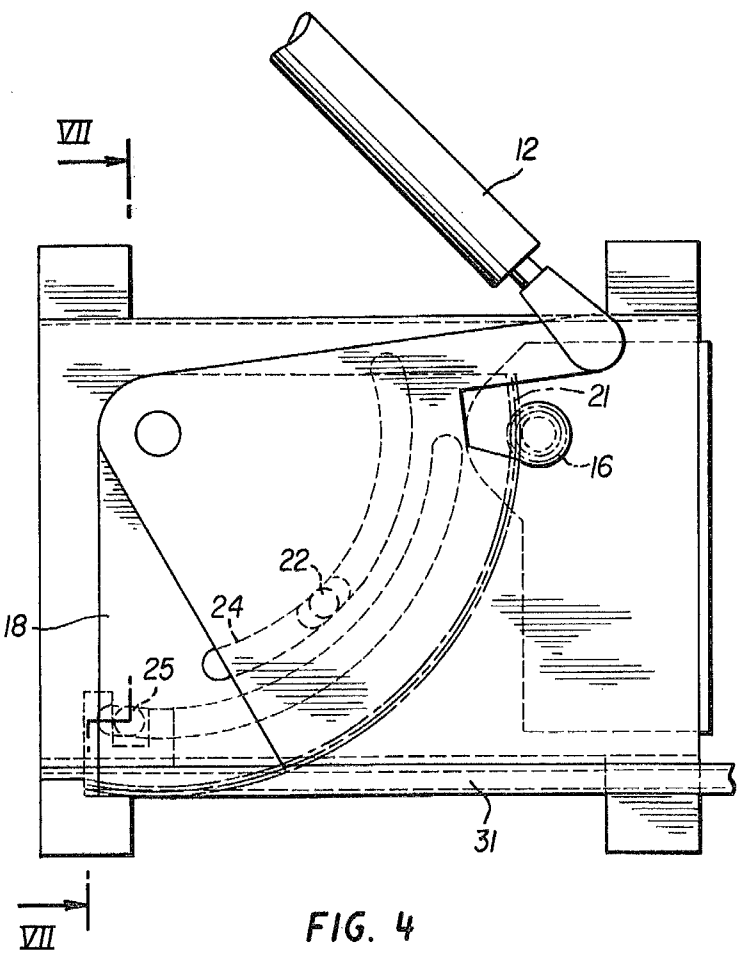

The pinion 16 of the motor continues its rotation and continues to cause the pivoting of the second sector 18 through its cogging 21 until it reaches the locking position in FIG. 4.

The slot 24 of the second sector allows the latter to pivot over the length which corresponds to the locking operation despite the fact that the pin 22 of the first sector has been immobilized, this while the pin 25 of the second sector 18 moves the fork 33 and hence the transmission cable 31 to make the hook 34 pivot by remote control by compressing its spring 37 and thus bringing it into the locked position of FIG. 10.

The unlocking and subsequent opening of the hatchback 1 reproduce the steps of operation of the mechanism in reverse, this after reversing the direction of rotation of the pinion 16. After the unlocking of the hatchback (FIG. 3), the remeshing 20 of the control sector 17 is facilitated by the locking sector 18, whose curvilinear slot 24 pulls the pin 22 of the first sector against which it is butting.

The invention is not limited to the example of use described but includes equivalent techniques.

Thus the transformations of successive movements might be obtained by means of belts or rod systems instead of a cable 31 and small rod 39, or the electrical command points could be greater in number, placed differently and involve more sophisticated circuitry, such as control by impulses and electronic direction reversal.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for the remote control and locking of a vehicle storage area hatch member having a lock, said apparatus comprising:

a plate mounted in said vehicle adjacent said hatch member;

an electric motor including an output pinion mounted on said plate;

an axis on said plate;

means for operating said hatch member, said means for operating comprising a first sector pivotally mounted on said axis and having a first cogged portion of a first length, said first cogged portion being engageable with said output pinion for rotation of said first sector, and a rod connected between said first sector and said hatch member whereby rotation of said first sector moves said hatch; and means for locking and unlocking said hatch member, said means for locking and unlocking comprising a second sector pivotally mounted on said axis and having a second cogged portion of a second length, said second cogged portion being engageable with said output pinion for rotation of said second sector, said means for locking and unlocking further comprising mechanical means intermittently connecting said second sector and said lock whereby rotation of said second sector operates said lock; wherein said second length of said second cogged portion is greater than said first length of said first cogged portion whereby, beyond a predetermined angle of rotation, only said second sector is rotated by said pinion, and wherein said mechanical means includes:

a sheathed cable having one end connected to said lock and another end located adjacent said second sector;

a second pin on said second sector; and a fork fixed to said other end of said cable at such a position relative to said second pin that said fork is engaged by said second pin beyond said predetermined angle of rotation of said second sector whereby the further rotation of said second sector operates said lock.

2. An apparatus for the remote control and locking of a vehicle storage area hatch member having a lock, said apparatus comprising:

a plate mounted in said vehicle adjacent said hatch member;

an electric motor including an output pinion mounted on said plate;

an axis on said plate;

means for operating said hatch member, said means for operating comprising a first sector pivotally mounted on said axis and having a first cogged portion of a first length, said first cogged portion being engageable with said output pinion for rotation of said first sector, and a rod connected between said first sector and said hatch member whereby rotation of said first sector moves said hatch; and means for locking and unlocking said hatch member, said means for locking and unlocking comprising a second sector pivotally mounted on said axis and having engaging means as well as a second cogged portion of a second length, said second cogged portion being engageable with said output pinion for rotation of said second sector, said means for locking and unlocking further comprising mechanical means connected to said lock and positioned to be intermittently engaged by said engaging means during the pivoting thereof, wherein said hatch member pivots to open and close on said vehicle, said means for operating said hatch member including means for limiting the angle of opening of said hatch member and means for limiting the angle of closing of said hatch member, said means for limiting the opening comprising a first curvilinear slot for a first predetermined length in said plate, and a first pin fixed to said first sector and slidably engageable in said first slot; and said means for limiting the closing comprising a gap in said first cogged portion, whereby pivoting of said first and second sectors positions said gap adjacent said pinion and said engaging means in engagement with said mechanical means to operate said lock.

3. The apparatus of claim 2 wherein said second sector lies between said plate and said first sector and including a second curvilinear slot of a second predetermined length on said second sector, said second slot being superimposed in part on said first slot, wherein said first pin passes through said second slot and wherein the length of said second slot is adjusted whereby said pin engages one end of said second slot following the unlocking of said hatch member so as to move said first and second sectors together.

4. The apparatus of claim 1 or claim 2 including a curvilinear third slot on said plate, said third slot coaxial with said first slot, wherein said second pin passes through said third slot.

5. The apparatus of claim 1 or claim 2 including a control circuit for said electric motor, said control circuit including a first switch located inside the passenger compartment of said vehicle and a second switch located on the outside of said vehicle and activated by a key.

6. The apparatus of claim 5 wherein said control circuit includes a third switch located inside said storage area, said third switch adapted to neutralize said first switch.

* * * * *